United States Patent [19]

Calvert

[11] 4,063,771

[45] Dec. 20, 1977

[54] BOTTLE CARRIER

[75] Inventor: Rodney K. Calvert, Dunwoody, Ga.

[73] Assignee: The Mead Corporation, Dayton, Ohio

[21] Appl. No.: 695,174

[22] Filed: June 11, 1976

[51] Int. Cl.[2] ..... B65D 71/00

[52] U.S. Cl. ..... 294/87.2; 206/150

[58] Field of Search ..... 294/87 R, 87.2–87.28; D9/176, 178; 53/48; 206/139, 145, 147–153, 157–161, 168, 196, 199, 201, 433; 224/45 A, 45 AA, 45 AB, 45 BA

[56] References Cited

U.S. PATENT DOCUMENTS

| | | | |
|---|---|---|---|
| D. 237,465 | 11/1975 | Calvert | D9/178 |
| D. 237,589 | 11/1975 | Calvert | D9/178 |
| D. 238,146 | 12/1975 | Calvert | D9/178 |
| 3,203,582 | 8/1965 | Waggner | D9/178 UX |
| 3,325,004 | 6/1967 | Wanderer | 206/150 |
| 3,397,003 | 8/1968 | Wherry | 294/87.2 |
| 3,633,962 | 1/1972 | Erickson | 294/87.2 |
| 3,727,754 | 4/1973 | Cunningham | 206/150 |

*Primary Examiner*—Johnny D. Cherry
*Attorney, Agent, or Firm*—Harold L. Marquis

[57] ABSTRACT

A bottle carrier with a body with a plurality of spaced means for receiving and retaining the enlarged neck-shoulders of bottles, and a bottle separator attached to the body by hinged legs in the same plane as the body so as to permit the extension of the legs to a position vertical to the body during the loading of bottles into the bottle carrier so that the bottle separator prevents contact between the body portions of bottles held in the carrier.

9 Claims, 7 Drawing Figures

BOTTLE CARRIER

This invention relates to a bottle carrier capable of supporting a plurality of bottles by their neck-shoulders and which has a bottle separator to prevent breakage of bottles from a swinging movement while being carried.

Several plastic top-gripping carriers are disclosed in the prior art. For example, Erickson U.S. Pat. No. 3,633,962, discloses an integrally formed bottle carrier in which the neck-shoulders of bottles are supported by uniformly split collars. Similar collars are shown in the accompanying drawings. Glazer U.S. Pat. No. 3,003,805 discloses a top-gripping carrier with collars in the periphery of the body with outwardly opening jaws. While these carriers satisfactorily support bottles, they have several drawbacks. These carriers have no means to keep the wide portions, or body, of the bottles from hitting each other when being carried, which can result in bottle breakage.

It is a principal object of this invention to provide a bottle separator that can be integrally molded with the carrier. It is a further object to design the separator so it is in the same plane as the body of the carrier when molded but can be easily extended into carrying position as the carrier is being loaded with bottles.

Unfortunately, the Erickson carrier is not too satisfactory for machine loading as it has no means to facilitate the movement of the carrier into precise alignment above the bottles and to permit its accurate release onto the neck-shoulders of the bottles below. It is another object of this invention to provide a means to facilitate machine loading of top-gripping bottle carriers.

This invention has also improved several other features of the Erickson carrier. Referring to FIG. 1 of the Erickson patent, the internal frames 11 are interconnected with a continuous outside frame 10. In this improvement the quantity of plastic used is reduced by eliminating one of the frames so that there is only a single frame surrounding each collar. Sufficient rigidity is maintained by connecting each individual frame to an adjoining frame by a ribbed member. Referring to FIG. 1 of the Erickson patent, the collar is also split opposite the split ends to provide an opening 19. This split end is connected by a yoke 20 which is connected to the individual frame 11 by a connection 21. Additional material was saved and the rigidity of the split collar increased by forming this opening in the body of the individual frame.

For a more complete understanding of the present invention, reference can be made to the preferred embodiments below and to their accompanying drawings, in which.

Figure 1:
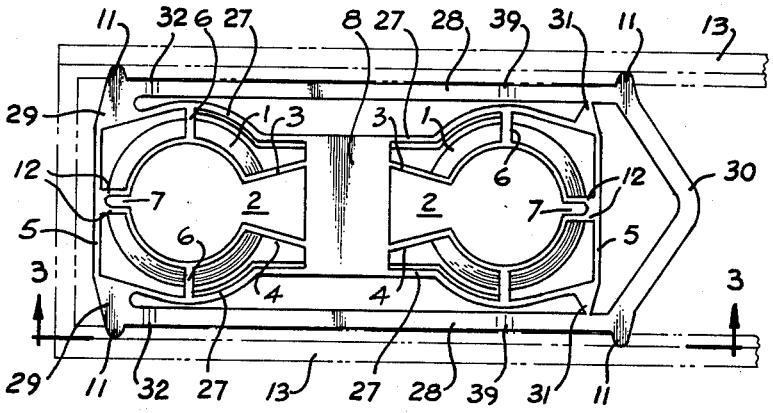
FIG. 1 is a plan view of the two-bottle carrier of the present invention positioned on the horizontal loading tracks of a machine for loading the carrier onto bottles.
Figure 2:
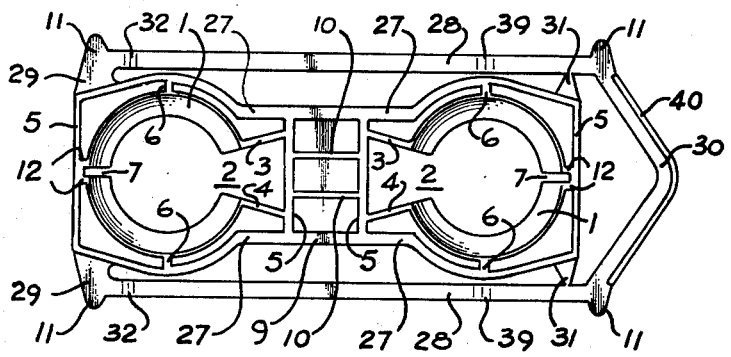
FIG. 2 is a view similar to FIG. 1 of the carrier as seen from below.

The construction of the two-bottle carrier of the preferred embodiment of this invention is shown in FIG. 1 and FIG. 2, which includes two split collars 1 at opposite ends of the carrier, with each split collar 1 capable of supporting the enlarged neck-shoulder of a bottle.

Each split collar 1 is of a conical shape with a larger diameter at the bottom than at the top of the collar, which facilitates the insertion and removal of bottles from the bottom of the split collar. Each collar 1 is split with a large opening 2 with connections 3 and 4 which taper away from each other in the direction from the collar to the portions of the individual frame 5 to which they are connected. The connections 3 and 4 can be attached to the interior portion of the individual frame as shown or attached to side member 27 of the individual frames or at the corners formed by each side member and the interior portion, depending upon configuration of the neck-shoulder of the bottle. The taper of the connections 3 and 4 facilitates spreading the ends of the split collar during loading and removal of bottles, while restraining the collar 1 from accidentally spreading and releasing the bottle when it is supporting a bottle. Each split collar 1 is supported within its individual frame 5 by a plurality of connections 6.

In this two-bottle carrier, the large openings 2 of each collar face each other to facilitate the removal of a bottle by rotating the bottle about its axis which passes through the connections 6 in the direction so the bottom of the bottle is moved outwardly from the end of the carrier forcing the neck through the large opening 2 thereby releasing the bottle from the carrier. If these openings were adjacent the ends of the carrier, the first bottle could not be easily removed as the other bottle would be in the line of travel in which the first bottle would need to be rotated.

In the preferred embodiment of this invention, the collar 1 is also split to form a small opening 7 opposite the large opening 2. The split ends 12 of this small opening 7 are attached to the individual frame 5. This small opening 7 facilitates spreading of the collar 1 during the insertion and removal of a bottle. Forming the small opening 7 directly into the individual frame 5 strengthens the rigidity of the split collar 1 and decreases its tendency to turn as a bottle is removed.

Each individual frame 5 is connected to its adjacent frame by a bridge 8. This bridge may have ribs 9 and 10 to maintain the strength of the carrier while permitting less plastic to be used (as shown in FIG. 2). Preferably the outer ribs 9 have a diameter approximately twice the diameter of the interior ribs 10. This bridge 8 serves as a handle in carrying the bottles.

Attached to the side members 27 of one of the individual frames are two parallel hinged positioning legs 28. Preferably each of these hinged positioning legs 28 is attached near the outer end of the edge of side member 27 of the frame 5 by a short interconnection 29. However, the hinged positioning legs 28 may be attached to the side members 27 close to bridge 8 or to the bridge itself. A bottle separator 30 is attached to the other end of each hinged positioning leg 28. The hinged positioning leg 28 may be connected to the side member 27 of the other collar by a short detachable connection 31 in order to maintain the hinged positioning leg in the same plane as the body 37 of the bottle carrier to facilitate handling and loading into the machine for applying the carrier to bottles. The detachable connection 31 may have a thin cross section or be serrated or weakened, at the point of attachment of the positioning leg to insure a clean and easy break when the positioning leg 28 is forced downward during application of the carrier to the bottles. Each hinged positioning leg 28 preferably has a short thin section 32, commonly known as a plastic hinge, to permit the hinged positioning leg to be extended in a position vertical to the body 37 of the carrier so that the bottle separator 30 prevents contact between the body portions 38 of the bottles held in the carriers. A separately fabricated hinge may be used in lieu of the plastic hinge.

Flexible tabs 11 projecting laterally from the body 37, may be attached on the outside edge of each positioning leg 28. These lateral tabs are used in supporting the carrier while it is guided into the proper position in the loading machine. The tabs 11 rest on two horizontal tracks 13 on which the carrier is moved to and maintained in the proper position above the bottles. When properly positioned a plunger bar (not shown) forces the carrier onto the bottle necks below. The flexible tab 11 is of sufficient flexibility to readily bend as the carrier is forced downwardly onto the bottles and thus releases the carrier from its position between the horizontal tracks. This loading machine is described in detail in Calvert and Fishback U.S. Pat. No. 3,859,773, issued Jan. 14, 1975. While two tabs 11 on each side are shown in FIG. 1, a single tab on each side may be sufficient if properly positioned to guide the carrier into proper position during loading. A single tab on each side of the carrier would be sufficient to temporarily support the carrier with certain types of loading machines. These flexible tabs may be attached on opposite sides of each individual frame 5 when the positioning legs 28 are attached to the side members 27 close to bridge 8 or to the bridge itself.

Figure 3:
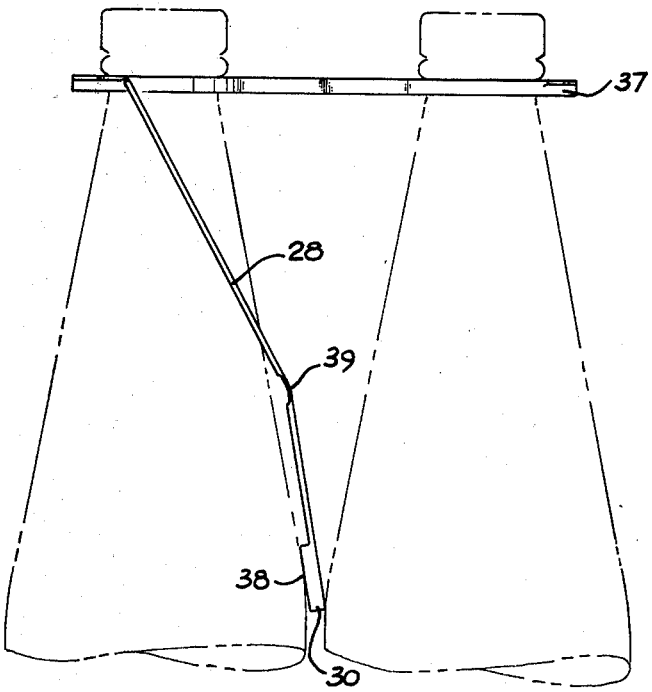
FIG. 3 is a side view of a two-bottle carrier loaded with bottles with the bottle separator in the extended position taken along the line 3—3 of FIG. 1, looking in the direction of the arrows.

In loading the carrier with bottles, the tabs 11 maintain the carrier in proper position on the horizontal track 13. A plunger bar forces the positioning legs 28 into a vertical position as shown in FIG. 3 as the carrier is being applied to the bottle. The other bottle is then moved into proper position and the carrier forced onto its neck-shoulder by the plunger bar. The bottle separator 30 is then in proper position to separate the bottles.

The bottle carrier of this invention has the unique capability of being able to be applied to bottles contained in a divided case. When such application is desired, the hinged positioning legs 28 are also hinged at 39 in the middle portion of the legs. During application to bottles, the plunger bar first bows the center of the hinged positioning leg 28 above the plane of the body 37 until the bottle separator 30 is positioned directly above the space between the bottle. As the plunger bar forces the carrier onto the bottle necks, the bottle separator 30 slides down between the bottles which is facilitated by the curvature of the bottle separator.

The bottle separator at 30 prevents the glass bottles from contacting each other during carrying which prevents breakage and possible injury to consumers therefrom. Preferably the bottle separator 30 is designed to separate the bottles at the location of their greatest diameter in the body portion. Because different types of bottles have their greatest diameter at different vertical locations on the bottle, the bottle separator 30 may be curved in relation to the positioning legs 28 and may also have one or more ribs 40 to insure adequate separation of various types of bottles.

While not shown, three or more split collars 1 can be interconnected in a single row by bridges 8.

Figure 4:
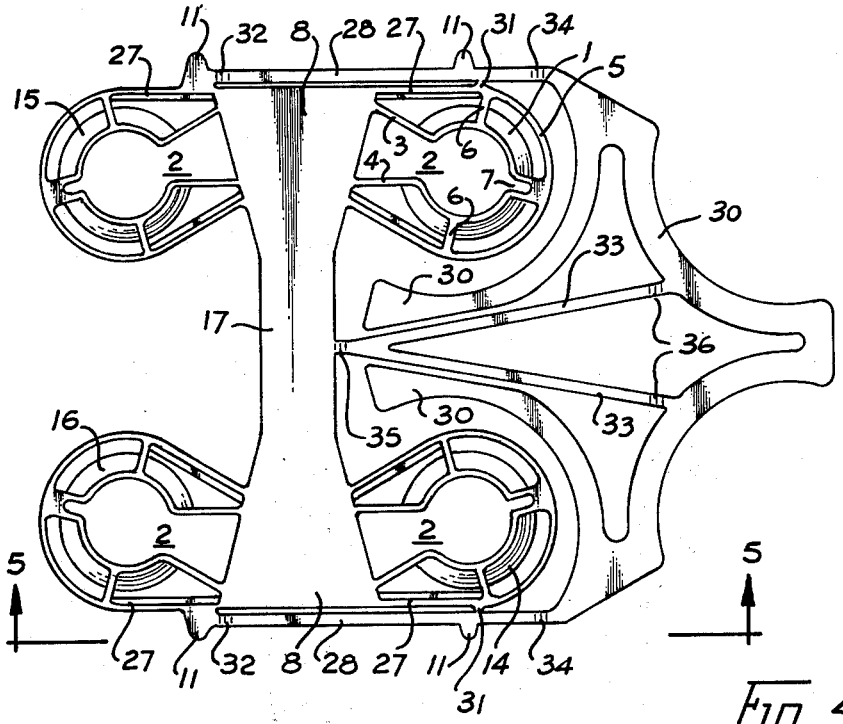
FIG. 4 is a plan view of the four-bottle carrier of this invention as seen from above.

The construction of the four-bottle carrier of this invention as shown in FIG. 4 includes the split collar 1 and individual frame 5 construction as shown for the two-bottle carrier. The split collars of the four-bottle carrier are arranged in two juxtaposed rows with collar 1 (as shown in FIG. 4) being in the same row as collar 14 while collars 15 and 16 are in the same row. The large openings 2 of each collar face inwardly into the carrier. Preferably the large opening 2 of each collar is turned slightly towards the adjacent end of the carrier to facilitate easy removal and insertion of bottles. The frame 5 around each collar is connected to the frame around the facing collar in the other row by bridge 8 which may be ribbed as bridge 8 in FIG. 2 as rib 10.

The four-bottle carrier may have a handle 17 attached to the opposite bridges 8. The handle 17 may be ribbed to strengthen the carrier. Two hinged positioning legs 28 are attached to the side members 27 of the individual frames 5 surrounding collars in the same row. These legs may be attached by a detachable connection 31 to the side members 27 of the individual frames 5 surrounding the collars in the other row. Two spaced flexible lateral tabs 11 are attached to the outside edge of each positioning leg 28 to facilitate application to bottles.

Figure 5:
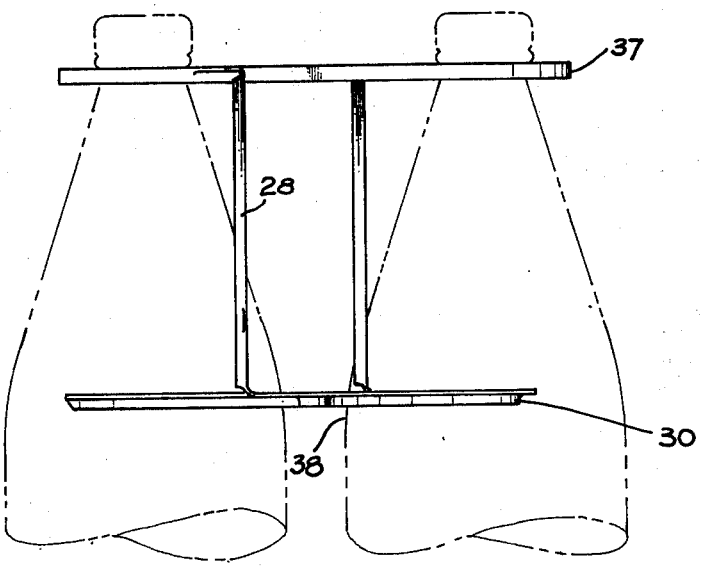
FIG. 5 is a side elevational view of the four-bottle carrier loaded with bottles with the bottle separator in the extended position taken along the line 4—4 of FIG. 4, looking in the direction of the arrows.

A bottle separator 30 is attached to the ends of positioning legs 28. Each leg also has a hinge 34 near the juncture of the leg and bottle separator. For carrying bottles with circular cross-section, the bottle separator 30 has a scalloped configuration to insure separation of each bottle from the other bottles loaded in the carrier without wasting space as shown in FIG. 5. Interior hinged positioning legs 36 may be used to increase the stability of the carrier.

The four-bottle carrier is loaded with bottles in substantially the same manner as the two-bottle carrier. The plunger bar bends the positioning legs 28 at the hinges 32 and the interior positioning legs 36 at hinge 35 until all the legs are in a vertical position as shown in FIG. 5. The plunger also bends the bottle separator 30 at hinges 34 and 36 so that it is parallel to the body 37 of the carrier as shown in FIG. 4.

Figure 6:
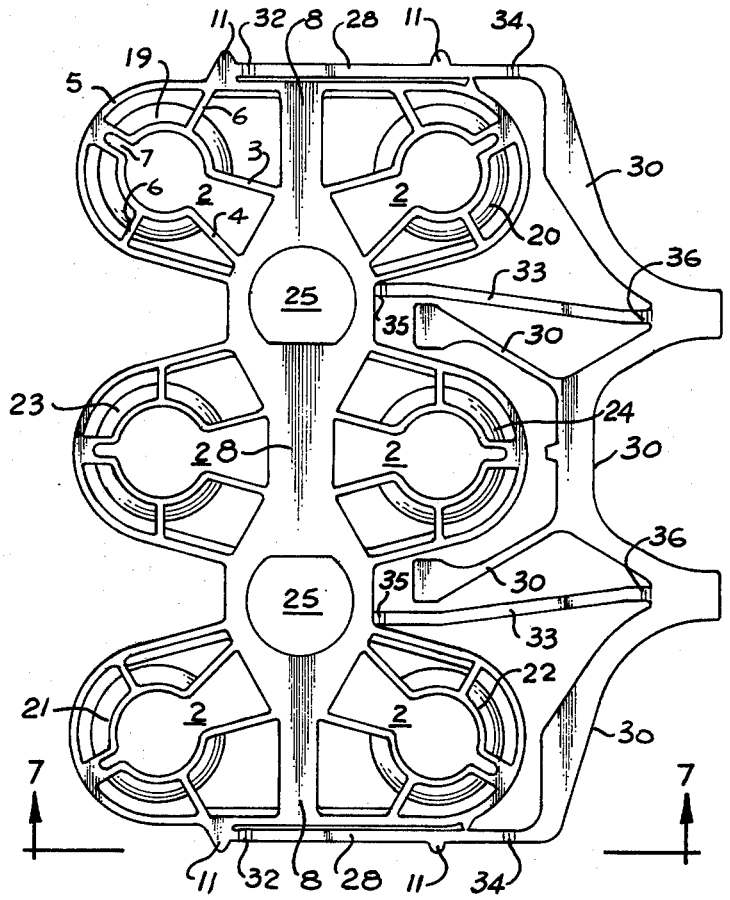
FIG. 6 is a plan view of the six-bottle carrier of this invention as seen from above.
Figure 7:
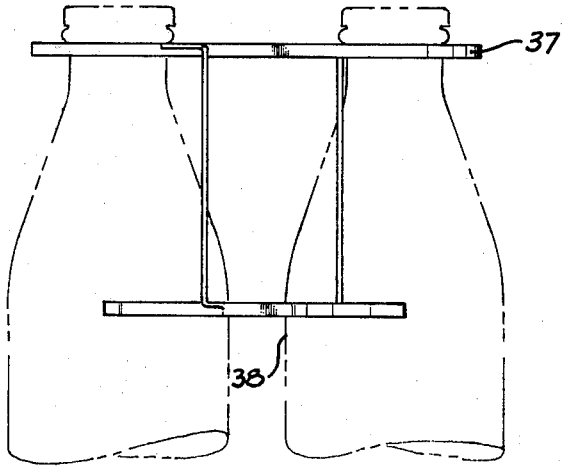
FIG. 7 is a side elevational view of the six-bottle carrier loaded with bottles with the bottle separator in the extended position taken along the line 5—5 of FIG. 6, looking in the direction of the arrows.

A six-bottle carrier is shown in FIG. 6 and 7. The split collar 19 and individual frames 5 are constructed as previously described. The positioning legs 28 and bottle separator 30 are constructed and the carrier loaded with bottles in a manner similar to the four-bottle carrier. p In the six-bottle carrier the large openings 2 of the adjacent end split collars 19 and 20, and also the adjacent split collars 21 and 22 on the other side, face inwardly toward the center of the carrier. The openings of the two center split collars 23 and 24 directly face each other. This arrangement of the large openings 2 of collars is necessary to facilitate ease of bottle insertion and removal. The individual frames 5 in the six-bottle carrier are interconnected by bridge 8, which may be reinforced in the ribs. Two finger openings 25 may be provided in the carrier for ease of handling.

All of these bottle carriers can be molded in a single unitary piece of a relatively rigid material, but possessing some flexibility, such as a high-density polyethylene or polypropylene, or may be molded separately and suitably secured. For example, the body of the carrier and the positioning legs and bottle separator could be molded separately and suitably attached. Preferably the carrier is molded in the one unitary piece with the positioning legs 28 and bottle separator 30 in the same plane as the body 37.

These bottle carriers can be thrown away after each use or reloaded for returning empty bottles to the store. The carrier is especially useful in conjunction with a divided case as the carrier can be applied to bottles contained in the case. The retail customer can remove the bottle carrier with bottles for carrying home and returning empty bottles to the store for shipping in the case.

The bottle separator 30 and positioning legs 28 may be used with top gripping bottle carriers other than the split collar carrier shown in the accompanying drawings. For example, it can be adapted for use with the carrier shown in FIG. 17 U.S. Pat. No. 3,003,805 (Glazer). The flexible lateral tabs 11 can also be used in the machine loading of other types of top-gripping bottle carrier.

Obviously, many other modifications are possible in light of the above teachings. It is, therefore, to be understood that within the scope of the invention may be individual modifications and variations other than is specifically descibed.

The embodiments of the invention in which an exclusive property or privilege is contained are defined as follows:

I claim:

1. An integrally formed bottle carrier of a relatively rigid flexible plastic material comprising a body with a plurality of spaced means arranged in a single row for receiving and retaining the enlarged neck-shoulders of bottles, and two parallel positioning legs, each leg having two ends and attached at one end thereof to an edge of the body opposite the other end and adjacent to the spaced means at one end of the body, and a bottle separator interconnecting the opposite ends of said legs, said body, legs and bottle separator being in the same plane, with the bottle separator and a portion of each leg near the opposite end of the leg extending beyond the opposite end of the body in their position in the same plane as the body, each leg having a plastic hinge near its attachment to the body in order to permit the legs to be extended downwardly out of their position in the same plane as the body during the loading of bottles into the bottle carrier so that the bottle separator is disposed between adjacent bottles so as to prevent contact between the facing body postions of adjacent bottles retained in the carrier.

2. The bottle carrier of claim 1 in which there are at least two flexible laterial tabs attached to opposite edges of the carrier and projecting outwardly from the carrier.

3. The bottle carrier of claim 1 in which there is a plastic hinge in each positioning leg in the middle portion of the leg.

4. An integrally formed bottle carrier of a relatively rigid flexible plastic material comprising a body with a plurality of spaced means for receiving and retaining the enlarged neck-shoulders of bottles arranged in two juxtaposed rows and a plurality of positioning legs, each leg having two ends and attached at one end thereof to the body and extending in substantially parallel positions to the ends of the other legs and an opposite end, and a bottle separator of a scalloped configuration interconnecting the opposite ends of said legs, said body, legs and bottle separator being in the same plane, with the bottle separator and a portion of each leg near the opposite end of the leg extending beyond the body in their position in the same plane as the body, each leg having a hinging means near its attachment to the body in order to permit the legs to be extended downwardly out of the position in the same plane as the body during the loading of the bottles into the bottle carrier, so that the bottle separator is disposed between adjacent bottles so as to prevent contact between the facing body portions of adjacent bottles retained in the carrier, with each positioning leg also having hinging means near the junction of the leg and bottle separator so as to permit the bottle separator to be bent into position substantially parallel with the body.

5. The bottle carrier of claim 4 in which there are at least two flexible lateral tabs attached to opposite edges of the carrier and projecting outwardly from the carrier.

6. An integrally formed bottle carrier made of a relatively rigid flexible plastic material comprising a body with a plurality of spaced collars arranged in a single row for receiving and supporting therein the enlarged neck-shoulders of bottles, each collar being split to form a large opening with a split end attached to the collar on each side of the opening, each collar being of a conical shape of a larger diameter at the bottom than at the top of the collar, an individual frame around and spatially separated from each split collar and within which the split collar is mounted, each of the split ends of the collar being flexibly attached to the individual frame to permit the split ends to be spread apart for the insertion and removal of the neck-shoulder of a bottle from the collar while retaining sufficient rigidity to support the bottle, a plurality of means connecting other portions of the collar to the individual frame, each frame being interconnected to an adjoining frame by a bridge and two positioning legs substantially parallel to each other, each leg having two ends one end of which is attached to opposite edges of an individual frame adjacent to one end of the body, and a bottle separator interconnecting the opposite end of said legs, said body, legs and bottle separator being in the same plane, with the bottle separator and a portion of each leg near the opposite end of the leg extending beyond the individual frame at the opposite end of the body in their position in the same plane as the body, each leg having a plastic hinge near its attachment to the body in order to permit the legs to be extended downwardly out of their position in the same plane as the body during the loading of the bottles into the bottle carrier so that the bottle separator is disposed between adjacent bottles so as to prevent contact between the facing body portions of adjacent bottles retained in the carrier and each positioning leg has a plastic hinge in the middle portion of the leg.

7. The bottle of claim 6 in which there are at least two flexible lateral tabs attached to opposite edges of the carrier and projecting outwardly from the carrier.

8. An integrally formed bottle carrier made of a relatively rigid flexible plastic material comprising a body with a plurality of spaced split collars arranged in two juxtaposed rows for receiving and supporting therein the enlarged neck-shoulders of bottles, each collar being split to form a large opening with a split end attached to the collar on each side of the opening, each collar being of a conical shape of a larger diameter at the bottom than at the top of the collar, an individual frame around and spatially separated from each split collar and within which the respective split collar is mounted, each of the split ends of the collar being flexibly attached to the individual frame to permit the split ends to spread apart for the insertion and removal of the neck-shoulder of a bottle from the collar while retaining sufficient rigidity to support the bottle, a plurality of means connecting other portions of the collar to the individual frame, each frame being interconnected to an adjoining frame by a bridge, with a plurality of positioning legs each leg having two ends one end of which is attached to the body in substantially parallel positions to the ends of the other legs and an opposite end, and a bottle separator of a scalloped configuration interconnecting the opposite ends of the legs, said body, legs and bottle separator being in the same plane, with the bottle separator and a portion of each leg near the opposite end of the leg extending beyond the body in their position in the same plane as the body, each leg having a plastic hinge near its attachment to the body in order to permit the legs to be extended downwardly out of their position in the same plane as the body during the loading of bottles into the bottle carrier, with each positioning leg also having a plastic hinge near the juncture of the leg and bottle separator, so as to permit the bottle separator to be bent into position substantially parallel with the body.

9. The bottle carrier of claim 8 in which there are at least two flexible lateral tabs attached to opposite edges of the carrier and projecting outwardly from the carrier.

* * * * *